US005863266A

United States Patent [19]

Starnes

[11] Patent Number: 5,863,266

[45] Date of Patent: Jan. 26, 1999

[54] SOCCER GAME WITH A PLURALITY OF GOALS

[75] Inventor: Todd A. Starnes, Dallas, Tex.

[73] Assignee: USA Collegiate, L.P., Dallas, Tex.

[21] Appl. No.: 775,781

[22] Filed: Dec. 31, 1996

[51] Int. Cl.[6] ..... A63B 63/00

[52] U.S. Cl. ..... 473/471; 273/400; 473/478

[58] Field of Search ..... 273/398, 400, 273/396, 127 R, 127 A, 127 B, 127 C, 127 D, 378, 382, 383, 389; 473/471, 478, 446

[56] References Cited

U.S. PATENT DOCUMENTS

| | | | |
|---|---|---|---|
| 2,256,555 | 9/1941 | Foltin et al. | 273/127 R |
| 3,120,958 | 2/1964 | Glass et al. | 273/383 X |
| 3,580,578 | 5/1971 | McCarthy | 473/471 |
| 3,746,340 | 7/1973 | Ellis | 473/471 |
| 4,105,208 | 8/1978 | Polhuis | 473/471 |
| 4,284,277 | 8/1981 | Leonard et al. | 473/471 |
| 4,286,786 | 9/1981 | Papadopoulos | 273/396 |
| 5,205,564 | 4/1993 | Lamberti et al. | 273/400 |
| 5,312,109 | 5/1994 | Cagle | 273/411 |

*Primary Examiner*—William H. Grieb
*Attorney, Agent, or Firm*—Gilbreth & Strozier, P.C.

[57] ABSTRACT

A soccer type goal in which upon scoring a goal, the scoring player pulls on a release strap to allow a cover to uncoil across the goal. An athletic ball game includes a number of these goals at each end of a playing field.

13 Claims, 4 Drawing Sheets

SOCCER GAME WITH A PLURALITY OF GOALS

BACKGROUND OF THE INVENTION

1. Field of the Invention

The present invention relates to process for playing a game, to a goal therefore, and to an apparatus therefore. In another aspect, the present invention relates to an athletic game with a plurality of goals, to goals therefore, and to an apparatus therefore. In another aspect, the present invention relates to a soccer type goal that includes a goal cover which can be closed when a goal is scored, and to an athletic game utilizing such goals.

2. Description of the Related Art

U.S. Pat. No. 3,746,340, issued Jul. 17, 1973 to Ellis, discloses a foot-ball (soccer) game employing a number of balls equal to the number of goals. As played, a plurality of players, an equal number on each opposing team, kick and try to goal a plurality of balls, preferably one ball for each player, each player simultaneously kicking off the ball from his individual goal towards the opposite end of the field occupied by the opposing team. Each team's balls are of different color, and each team tries to get as many balls as possible, irrespective of color, into the opposite team's goals.

U.S. Pat. No. 4,105,208, issued Aug. 8, 1978 to Polhuis, discloses an indoor football (soccer) match set, including at least one gate or goal, preferably two goals, and a ball. A movable plate within the goal responds to contact with a ball entering the goal, to increment a counter mechanism or generate a goal signal that will ring a bell or light a lamp.

U.S. Pat. No. 4,284,277, issued Aug. 18, 1981 to Leonard, et al., discloses a kick ball game and apparatus kit therefor. The playing surface is divided into team zones with one goal at each end of the far ends, and a fabric type mesh net enclosing the perimeter of the playing surface to contain the ball as well as to provide a surface off of which the ball may be ricocheted as part of the strategy of play.

U.S. Pat. No. 4,286,786, issued Sep. 1, 1981 to Papadopoulos, discloses a soccer training goal, which addition to the traditional framing and netting, includes an inclined plane connected to the goal frame at the bottom of the goal space and inclined downwardly toward the goal opening. A soccer ball kicked into the goal space will initially be retained within the goal space by hitting the net, then drop onto the inclined plane, and then roll off of the inclined plane out of the goal back to the practicing kicker.

U.S. Pat. No. 5,312,109, issued May 17, 1994 to Cagle, discloses a soccer court including a rectangular playing area approximately the size of a tennis court and preferably covered with artificial turf, an enclosing wall with goal openings in the end walls and goal nets disposed outside of the playing area.

In spite of the above advancements in the athletic game art, there is a need for an improved goal.

There is another need in the athletic game art for an improved athletic game.

There is even another need in the athletic game art for an improved method of operating a goal.

There is still another need in the athletic game art for an improved method of playing a game.

These and other needs in the art will become apparent to those of skill in the art upon review of this specification, including its drawings and claims.

SUMMARY OF THE INVENTION

It is an object of the present invention to provide for an improved goal.

It is another object of the present invention to provide for an improved athletic game.

It is even another object of the present invention to provide for an improved method of operating a goal.

It is still another object of the present invention to provide for an improved method of playing a game.

These and other objects of the present invention will become apparent to those of skill in the art upon review of this specification, including its drawings and claims.

According to one embodiment of the present invention, there is provided an athletic game goal. The goal is a soccer type goal and includes a goal frame defining a scoring zone and further defining an opening to the scoring zone. The goal also includes a cover affixed to the goal frame, which cover may be in a first position away from the opening prior to scoring, and in a second position across the opening after scoring.

According to another embodiment of the present invention, there is provided an athletic ball game, which generally includes a playing zone, which as non-limiting examples could be a field, swimming pool, arena, ring, court, or the like, having at least one of the above described goals at two ends of the field.

According to even another embodiment of the present invention, there is provided a method for operating the above described goal. The method generally includes the first step of positioning the cover in the first position. Next, the method includes positioning a ball in the scoring zone. Finally, the method includes positioning the cover in the second position.

According to still another embodiment of the present invention, there is provided a method for playing a game comprising N number of the above goals at each end of a playing field. The method first includes step (a) of positioning the cover in the first position for each of the N goals. The method then includes step (b) of positioning a ball in the scoring zone of one of the goals having a cover in the first position, and then step (c) of positioning the cover of the goal with the ball in the scoring zone, in the second position. Steps (b) and (c) are repeated until the covers of all of the N goals at one of the two ends of the playing field are in the second position, or until a predetermined time expires.

BRIEF DESCRIPTION OF THE DRAWINGS

For the following FIGS. 1–4, like numbers in the drawings refer to like elements.

DETAILED DESCRIPTION OF THE INVENTION

Figure 1:
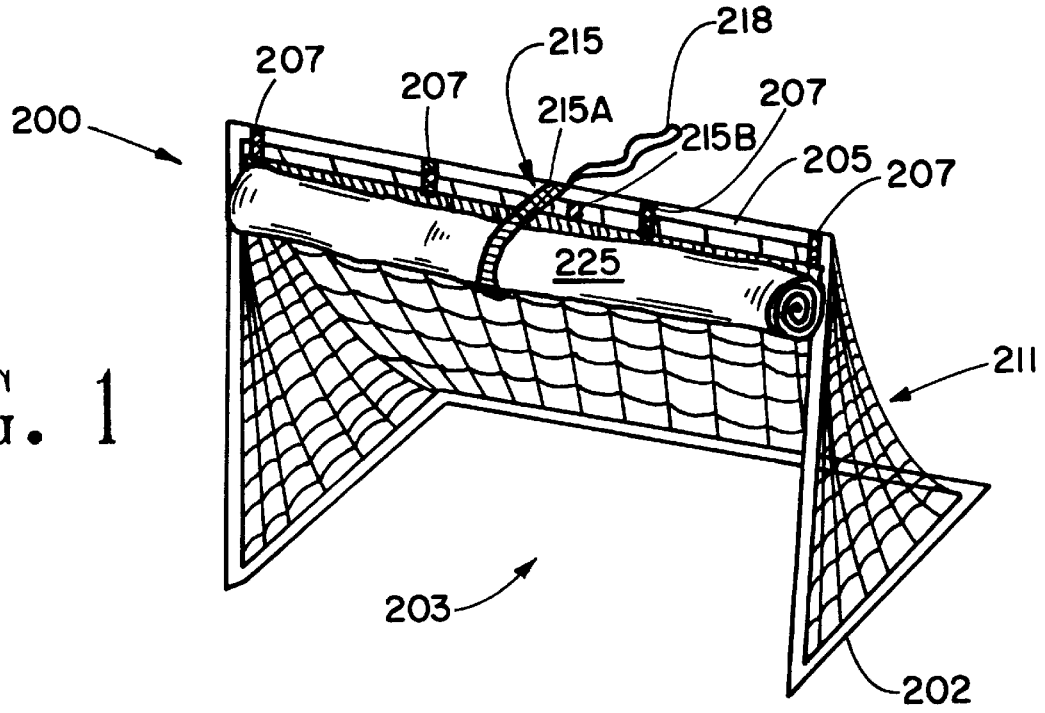
FIG. 1 is an illustration of one embodiment of a goal 200 of the present invention, before the scoring of a goal, showing framing 202, crossbar 205, netting 211, scoring zone 203, coiled goal cover 225, goal cover fasteners 207, goal cover restraint 215 and goal cover release 218.

The present invention will first be described by reference to FIGS. 1 and 2, which respectively are an illustration of and side view of one embodiment of a goal 200 of the present invention.

As shown, goal 200 includes framing 202 defining a scoring zone 203. The present invention is not limited to any type of material for framing 202, other than framing 202 should be made of material durable enough to sustain routine player contact during play, and any contact with a ball, puck or other object that might be launched at goal 200. Framing 202 must also provide support for netting 211 and goal cover 225. Non-limiting examples of suitable materials for framing 202 include metal, wood, thermoplastics, thermosets, and composites. For safety, it is desirable that framing 202 generally be designed to provide some "give" during contact with a player, which makes light metals such as aluminum, or plastics preferred materials. While framing 202 may be anchored to the ground, again for safety, it is desirable that framing 202 be self supporting and not anchored to the ground.

Framing 202 supports netting 211 which serves to capture a scoring ball. Netting for soccer type goals are well known in the sports art, and any suitable net may be utilized.

Figure 2:
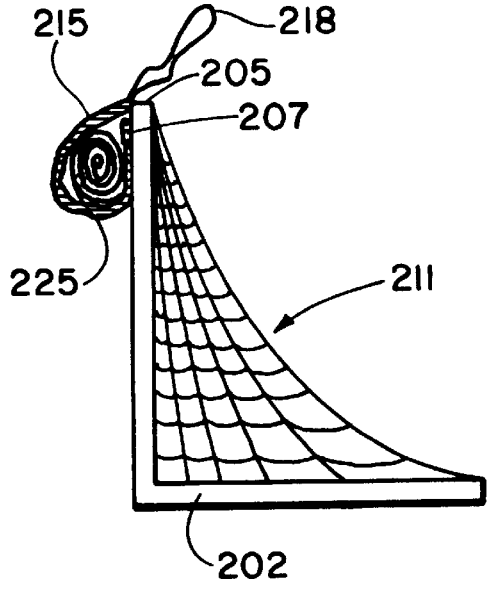
FIG. 2 is a side view of goal 200 of FIG. 1 showing framing 202, crossbar 205, netting 211, coiled goal cover 225, goal cover fasteners 207, goal cover restraint 215 and goal cover release 218.

Crossbar 205 of framing 202 provides support for goal cover 225, which is shown in FIGS. 1 and 2 in its pre-goal coiled position. Goal cover fasteners 207 keep goal cover 225 affixed to framing 202, with goal cover restraint 215 keeping goal cover 225 restrained in a pre-goal coiled position.

Goal fasteners 207 may be any fastener or system suitable to affix goal cover 225 to framing 202. As nonlimiting examples, goal cover 225 may include eyelets which are tied by rope to crossbar 207, may include eyelets which engage hooks affixed to crossbar 207, may include hook and loop fastening means fasteners with mating members affixed to goal cover 225 and crossbar 207, as well as any other suitable type of fasten or system.

Goal cover restraint 215 keeping goal cover 225 restrained in a pre-goal coiled position. As a non-limiting example, in the embodiment shown, goal restraint 215 comprises a strap member that is looped around coiled goal cover 225, with both ends 215A and 215B affixed to crossbar 205. As one or both of ends 215A and 215B must be easily freeable from crossbar 205, they are releasably affixed to crossbar 205, with for example snaps or hook and loop fastening means. Goal cover release 218 is used to free end 215A (optionally and/or end 215B) from crossbar 205 and thereby release goal cover 225 to be uncoiled by gravity.

Figure 3:
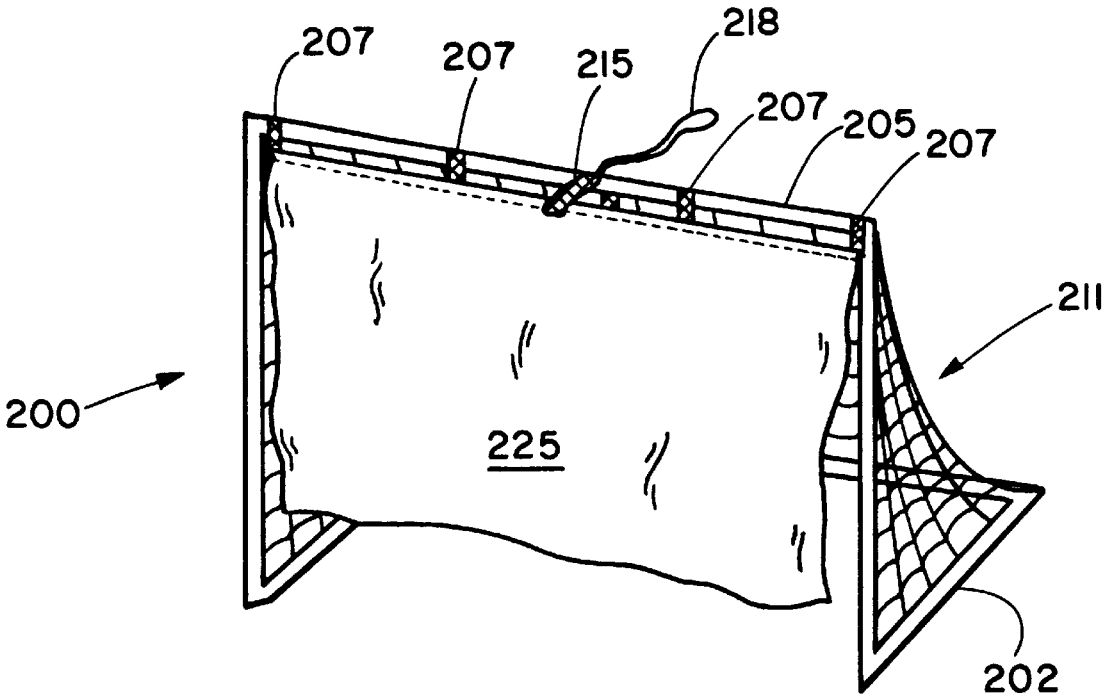
FIG. 3 is an illustration of goal 200 after the scoring of a goal, showing framing 202, crossbar 205, netting 211, scoring zone 203, unfurled goal cover 225, goal cover fasteners 207, goal cover restraint 215 and goal cover release 218.

Upon the scoring of a goal, the scoring player is allowed to pull goal cover release 218 to free end 215A from crossbar 205 and thereby release goal cover 225 to be uncoiled by gravity. It is believed that this pulling of goal cover release 218 serves as a celebratory release for the scorer, like the spiking of a football by a football player upon scoring a touchdown. Referring now to FIG. 3, there is shown goal 200 in a post-goal position with goal cover 225 uncoiled and covering the opening to scoring zone 203.

Goal cover 225 may be decorated with a team's colors, a team's emblem, or even advertising, which will be visible upon the scoring of a goal.

Goal 200 finds utility in a wide variety of games including traditional soccer, field hockey, ice hockey, in-line skate hockey, water polo, as well as any other type of game utilizing a soccer type goal.

The present invention also provides a new soccer-type athletic game utilizing the above described goals 200. While many variations in the game may be possible, at the very least, a soccer type game is envisioned in which two or more goals are at each end of a field, with each team attempting to score on each of the opponent's goals. Preferably, at least three goals are at each end of the field, and more preferably at least five goals are at each end of the field.

As non-limiting examples, variations in this new soccer-type athletic game for the goals include, size of goal, position of goals, number of goals, number of times a team must score on each goal, and whether goals must be scored on in any particular order or random, As more non-limiting examples, other variations in this new soccer-type athletic game include duration of play, number of players on a team, whether to allow substitutions, whether to allow goalkeepers, size of field, type of ball, number of balls, number of timeouts, when to stop clock, definition of fouls, number of fouls allowed, number of referees, whether to allow use of hands, and whether to use non-encroachment zones.

Figure 4:
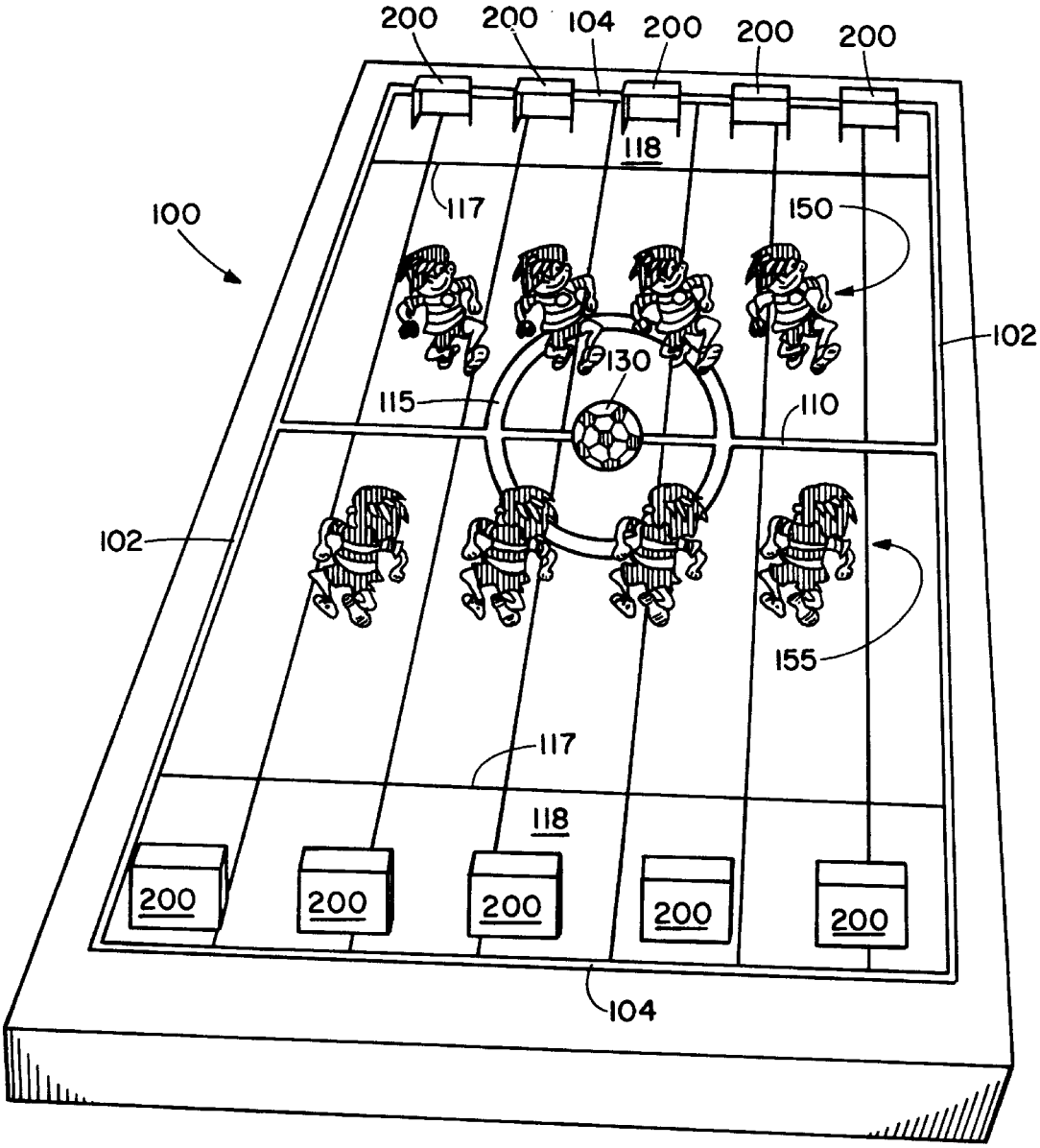
FIG. 4 is a schematic illustration of one embodiment of a playing zone, which as non-limiting examples could be a field, swimming pool, arena, ring, court, or the like, of the present invention, showing playing field 100, sidelines 102, endlines 104, center line 110, nonencroachment lines 117, plurality of goals 200, ball 130, and two opposing teams 150 and 155.

Referring now to FIG. 4 there is shown a schematic illustration of one embodiment of the playing field of the present invention, showing playing field 100, sidelines 102, endlines 104, center line 110, non-encroachment lines 117, plurality of goals 200, ball 130, and two opposing four player teams 150 and 155.

As a non-limiting example, the following rules in Table 1 are proposed to be used with the field of FIG. 4.

TABLE 1

| | Non-limiting example of rules for game |
|---|---|
| Item | Rule |
| Playing Field | Approximately ⅓ of the size of regulation soccer field. 50 yds long × 25 yds wide with no penalty area. A non-encroachment zone 15 feet from each end line is added. 5 goals are equally spaced along each end line. |
| Players | Each team has 4 players on the field at a time and 1 substitute. No goalkeepers are permitted. Free substitution is allowed on any dead ball. |
| Scoring | Goals may be scored upon in any order. Upon scoring a goal, the scoring |

TABLE 1-continued

| Item | Non-limiting example of rules for game<br>Rule |
|---|---|
| | player lowers the goal cover to indicate that goal is eliminated. All goals must be scored from within the offensive zone (i.e., between center line and encroachment line nearest defender's goal). |
| Time of Play | 20 minutes or when all 5 goals of one team have been eliminated, whichever comes first. The clock will stop for injuries only. |
| Non-encroachment Zone | The ball may be played by either team within the zone. If a defender touches the ball within the zone, a penalty kick (from anywhere within the center circle) will be awarded. If the ball dies within the zone from an offensive players kick, the other team gets the ball for a goal kick. |
| Ball Contact | Players may use any part of body to control and move the ball except any part of hands or arms (a player may pick up ball after goal is scored). |
| Restarts (fouls, goals, out of bounds) | The game is restarted with an indirect kick-in. |
| Fouls | Generally regular soccer rules apply with the exception of penalty kicks. Free kicks are indirect and are taken from the spot of the foul, except for encroachment zone violations. |
| Out of bounds | The ball is inbounded where it went out. The game is started by a kick-in by the opponent of the team touching the ball last before going out. When the ball is in the encroachment zone, the ball is set into play by a corner kick from the encroachment zone line. |
| Winner | Team scoring all five goals, or having the most goals at the end of regulation time. |
| Tie Breaker | A shout-out takes place from the center circle on the remaining open goals. All players are available to shoot. The teams will alternate shots. It still tied, the shoot-out becomes a sudden death format. Shots are taken from within the center circle anywhere along the line. |

As an alternative to manually operated goal cover release 218, an automatic system may be utilized, in which a ball detector relays, either mechanically, electronically, or wireless, a signal to release the goal cover 225.

Figure 5:
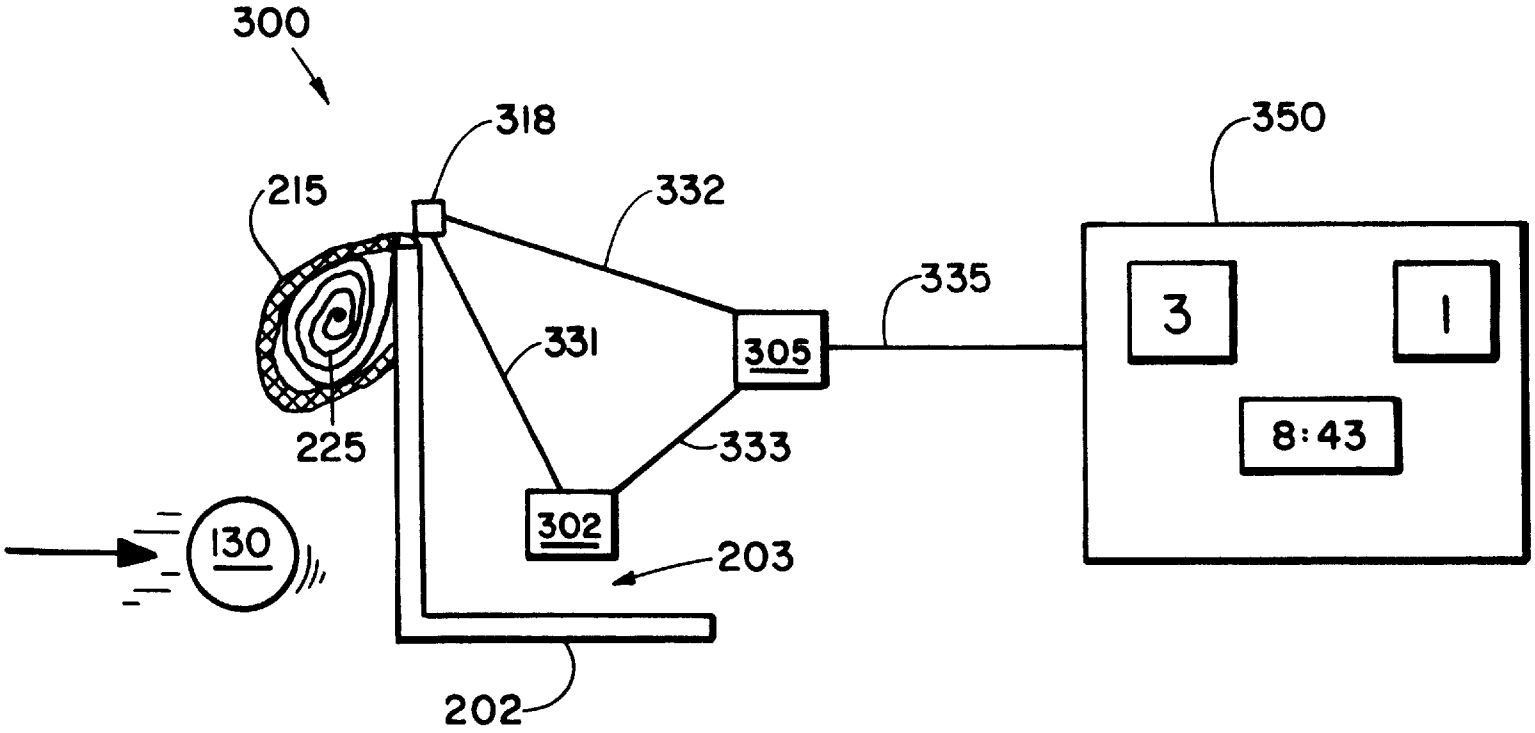
FIG. 5 is a schematic representation of an optional signaling system 300 of the present invention, which may be utilized with goal 200, showing ball detector 302, release switch 318, computer 305, and scoreboard 350.

Referring now to FIG. 5 there is shown a schematic representation of an optional signaling system 300 of the present invention, which may be utilized with goal 200, showing ball detector 302, release switch 318, computer 305, and scoreboard 350.

As shown, upon entry of ball 130 into scoring zone 203, detector 302 in one embodiment provides a signal 331 directly to release 318, or in an alternative embodiment provides a signal 333 to controller 305 which in turn provides a signal to release 318, to release goal cover 225. An optional scoreboard 350 may be provided which responds to signals 335 from controller 305. As shown in FIG. 5, optional scoreboard 350 can be configured to provide total score. Alternatively, optional scoreboard 350 can be configured to show which goals have been eliminated and which are still in play.

Detector 302 may be any suitable type of detector and may operate upon mechanical contact with ball 130, or may utilize non-contact methods of detecting ball 130. The signals 331, 333 and 335 may be any suitable type of signal, non-limiting examples of which include a mechanical linkage signal, electronic, IR, laser, ultrasonic, digital, data and the like.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. An athletic game goal apparatus comprising:

(a) a goal frame defining a scoring zone and further defining an opening to the scoring zone; and (b) a cover affixed to the goal frame wherein the cover is in a first position away from the opening prior to scoring, and in a second position covering the opening to the scoring zone after scoring, wherein in the first position the cover is coiled and positioned above the opening, and in the second position the cover is uncoiled and positioned across the opening;

(c) a fastener which is connected to and holds the cover in the first position;

(d) netting supported by the goal frame.

2. An athletic ball game comprising:

(a) a playing zone having first and second ends;

(b) at least two goals positioned at each of the first and second ends, wherein the goals each comprise:

(1) a goal frame defining a scoring zone and further defining an opening to the scoring zone; and (2) a cover affixed to the goal frame, wherein the cover is in a first position away from the opening prior to scoring, and in a second position covering the opening to the scoring zone after scoring.

3. The game of claim 2 comprising at least three goals positioned at each of the first and second ends.

4. An athletic ball game comprising:

(a) a playing zone having first and second ends;

(b) at least one goal positioned at each of the first and second ends, wherein the goals each comprise:

(1) a goal frame defining a scoring zone and further defining an opening to the scoring zone; and (2) a cover affixed to the goal frame, wherein in a first position the cover is coiled and positioned above the opening, and in a second position the cover is uncoiled and positioned across the opening.

5. The game of claim 4 further including:

(c) a fastener which is connected to and holds the cover in the first position.

6. The game of claim 5 comprising at least five goals positioned at each of the first and second ends.

7. The game of claim 4 comprising at least two goals positioned at each of the first and second ends.

8. The game of claim 4 comprising at least three goals positioned at each of the first and second ends.

9. A method for operating a goal, wherein the goal comprises (1) a goal frame defining a scoring zone and further defining an opening to the scoring zone; and(2) a cover affixed to the goal frame wherein the cover can be in a first position away from the opening and a second position covering the opening to the scoring zone, the method comprising:

(a) positioning the cover in the first position by coiling the cover;

(b) positioning a ball in the scoring zone; and (c) positioning the cover in the second position.

10. The method of claim 9 wherein step (c) comprises uncoiling the cover.

11. A method for playing a game comprising N goals at each of two ends of a playing zone, wherein each goal comprises (1) a goal frame defining a scoring zone and further defining an opening to the scoring zone; and(2)a cover affixed to the goal frame, wherein the cover can be in a first position away from the opening and a second position across the opening, the method comprising:

(a) positioning the cover in the first position for each of the N goals;

(b) positioning a ball in the scoring zone of one of the goals having a cover in the first position;

(c) positioning the cover of the goal with the ball in the scoring zone, in the second position; and (d) repeating steps (b) and (c) until the covers of all of the N goals at one of the two ends of the playing zone are in the second position, or a predetermined time expires.

12. The method of claim 11 wherein step (a) comprises coiling the cover.

13. The method of claim 12 wherein step (c) comprises uncoiling the cover.

* * * * *